US005519481A

United States Patent [19]

Kuo

[11] Patent Number: 5,519,481

[45] Date of Patent: May 21, 1996

[54] ADAPTIVE DECURLER FOR SELECTIVE DECURLING OF LOCALIZED IMAGE AREAS

[75] Inventor: Youti Kuo, Penfield, N.Y.

[73] Assignee: Xerox Corporation, Stamford, Conn.

[21] Appl. No.: 320,360

[22] Filed: Oct. 11, 1994

[51] Int. Cl.[6] ..... G03G 21/00

[52] U.S. Cl. ..... 355/309; 162/271; 355/285

[58] Field of Search ..... 355/282, 285, 355/289, 290, 295, 308, 309, 208; 162/270, 271

[56] References Cited

U.S. PATENT DOCUMENTS

| | | | |
|---|---|---|---|
| 3,344,493 | 10/1967 | Telgheider . | |
| 4,360,356 | 11/1982 | Hall | 162/271 X |
| 4,926,358 | 5/1990 | Tani | 364/562 |
| 4,977,432 | 12/1990 | Coombs et al. | 355/309 |
| 5,084,731 | 1/1992 | Baruch | 355/208 |
| 5,183,454 | 2/1993 | Kurosawa et al. | 162/271 X |
| 5,187,527 | 2/1993 | Forlani et al. | 355/282 |
| 5,202,737 | 4/1993 | Hollar | 355/308 |
| 5,287,157 | 2/1994 | Miyazato et al. | 355/309 |
| 5,392,106 | 2/1995 | Bigenwald et al. | 355/309 |
| 5,414,503 | 5/1995 | Siegel et al. | 355/309 |

*Primary Examiner*—Sandra L. Brase
*Attorney, Agent, or Firm*—Kevin R. Kepner

[57] ABSTRACT

An apparatus for adaptive localized sheet decurling in an electrophotographic printing machine. A segmented decurling device forms a drive nip with an elastically deformable surfaced roll. A plurality of sensors are provided to determine the basis weight of the copy sheet, the density of the image being transferred to the copy sheet and fused thereon, the relative humidity of the machine environment, the process speed of the print engine, and any other relevant parameters. Signals indicative of these parameters are generated and sent to the machine controller which processes these signals to determine the degree of curl expected in a sheet. Based on the degree of of curl for each sheet section corresponding to a decurler segment, the decurler segment is actuated to a setting which should provide the proper amount of mechanical decurling force. Each segment is activated only for the duration deemed necessary to decurl the imaged sheet portion corresponding thereto.

20 Claims, 5 Drawing Sheets

ADAPTIVE DECURLER FOR SELECTIVE DECURLING OF LOCALIZED IMAGE AREAS

This invention relates generally to a method and system for decurling a sheet, and more particularly concerns an adaptive apparatus and method to selectively decurl localized portions of a sheet.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated by a fuser to permanently affix the powder image to the copy sheet. A curl or bend may be created in a sheet as the sheet passes through the fuser in the printing machine.

A curled sheet may be undesirable from a variety of standpoints. For instance, the curled sheet may be difficult to handle as the sheet is processed in a printing machine. Curled sheets may tend to produce jams or misfeeds within the printing machine. Additionally, sheets having a curl or bend therein may be esthetically undesirable to consumers thereof. Furthermore, an imaged copy sheet may curl partially or locally depending on the distribution of images on the sheet. For instance, a sheet may curl up diagonally if large areas of heavy images are located at two opposite corners of a sheet.

Some printing machines utilize mechanical decurlers which bend the fused sheet around a roll or mandrel to mechanically induce a bend in the opposite direction of the sheet curl to eliminate or minimize the curl. These conventional decurlers apply uniform bending across a sheet in the direction perpendicular to the process direction. These uniform bendings are indiscriminately applied to imaged and unimaged areas, or curled or uncurled areas. Consequently, while a local curl area is flattened, other noncurled areas may become curled as a result of the unnecessary bending applied to the unimaged or noncurled areas. Most of the mechanical decurlers utilize a fixed bend radius or a fixed radius and a bypass path through which sheets are passed depending on the degree of curl. It is also possible to vary the bend on the sheet to decurl it based upon the amount of image data on the sheet.

It is desirable to provide a system that can predict the degree and direction of localized curl that is likely based on parameters such as toner mass per unit area, sheet basis weight, fusing speed, relative humidity of the machine or sheet environment, etc. and adjust the bending locally.

The following disclosures may be relevant to various aspects of the present invention:

U.S. Pat. No. 5,084,731

Patentee: Baruch

Issue Date: Jan. 28, 1992

U.S. Pat. No. 4,977,432

Patentee: Coombs et al.

Issued: Dec. 11, 1990

U.S. Pat. No. 4,926,358

Patentee: Tani et al.

Issue Date: May 15, 1990

U.S. Ser. No. 08/032,716

Inventor: Resto et al.

Filing Date: Mar. 17, 1993

U.S. Ser. No. 08/032,717

Inventor: Resto et al.

Filing Date: Mar. 17, 1993

The relevant portions of the foregoing disclosures may be briefly summarized as follows:

U.S. Pat. No. 5,084,731 discloses a multiple nip decurler that varies the direction and amount of force applied to a sheet based upon image data..

U.S. Pat. No. 4,977,432 discloses a device which is disposed in the path of paper leaving a printing unit or processor such as an office copier, facsimile or non-impact printer and has an arcuate concave guide and a feed roll which causes the paper to pass between the guide and the feed roll to decurl the paper.

U.S. Pat. No. 4,926,358 describes a decurling system that measures the direction and size of a sheet curl and then varies the curling force and direction accordingly.

U.S. Ser. No. 08/032,716 describes a system for decurling a sheet with a toner image fused thereon which includes a mechanism for reducing the temperature of the toner image from a first temperature to a second temperature, the second temperature being less than the glass transition temperature of the toner material. The system further includes a mechanical decurler to apply a force to the sheet and the toner after the temperature of the toner has been reduced.

U.S. Ser. No. 08/032,717 describes a system for decurling a sheet with a toner image fused thereon which includes a mechanism for generating a flow of room ambient air and directing the flow of room ambient air onto the sheet. The decurling system includes a decurler adapted to apply mechanical force to the sheet after the flow of room ambient air has been directed onto the sheet by the directing mechanism.

In accordance with one aspect of the present invention, there is provided a printing machine in which an image is fixed to a sheet. The improvement comprises a member having an elastically deformable surface and a decurling member adjacent said member to form a nip therebetween, said decurling member including a plurality of protrusions extending outwardly from a portion of a surface in the nip to cause localized deformation of the sheet passing through the nip.

In accordance with a second aspect of the present invention, there is provided a printing machine in which an image is fixed to a sheet. The improvement comprises a member having an elastically deformable surface and a plurality of decurling sections adjacent said member to form a nip therebetween, said plurality of sections extending in a direction substantially transverse to a direction of sheet travel through the nip.

Pursuant to another aspect of the present invention, there is provided a method for predicting the amount of curl in a sheet and applying a variable localized decurling force. The method comprises the steps of determining at least one of a plurality of parameters effecting decurling a sheet and generating a parameter signal indicative thereof and adjusting, in response to the parameter signal, the decurling force being applied to specific portions of the sheet by a sheet decurler.

Pursuant to yet another aspect of the present invention, there is provided an apparatus for decurling a sheet. The apparatus comprises a member having an elastically deformable surface and a decurling member adjacent said member to form a nip therebetween, said decurling member including a plurality of protrusions extending outwardly from a portion of a surface in the nip to cause localized deformation of the sheet passing through the nip.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 9:
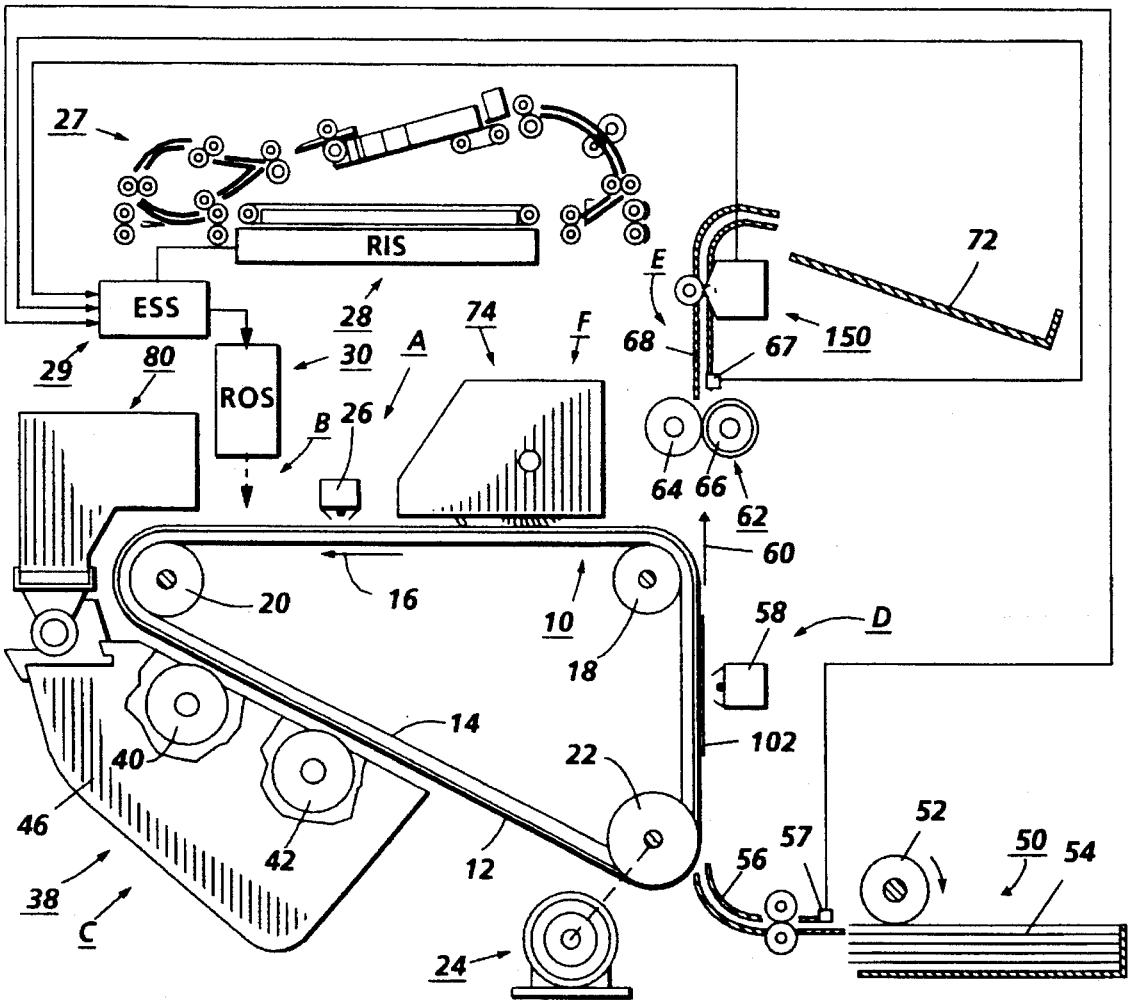
FIG. 9 is a schematic elevational view of an electrophotographic printing machine incorporating the FIG. 4 decurler.

For a general understanding of the features of the present invention, reference is made to the drawings. In the drawings, like reference numerals have been used throughout to identify identical elements. FIG. 9 schematically depicts an electrophotographic printing machine incorporating the features of the present invention therein. It will become evident from the following discussion that the decurler of the present invention may be employed in a wide variety of devices and is not specifically limited in its application to the particular embodiment depicted herein.

Referring to FIG. 9 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

The FIG. 9 printing machine employs a belt 10 having a photoconductive surface 12 deposited on a conductive ground layer 14. Preferably, photoconductive surface 12 is made from a photoresponsive material, for example, one comprising a charge generation layer and a transport layer. Conductive layer 14 is made preferably from a thin metal layer or metallized polymer film which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges the photoconductive surface, 12, to a relatively high, substantially uniform potential. After photoconductive surface 12 of belt 10 is charged, the charged portion thereof is advanced through exposure station B.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers.

The signals from ESS 29, corresponding to the continuous tone image desired to be reproduced by the printing machine, are transmitted to ROS 30. ROS 30 includes a laser with rotating polygon mirror blocks. Preferably, a nine facet polygon is used. The ROS illuminates the charged portion of photoconductive belt 20 at a resolution of about 300 or more pixels per inch. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 20 on a raster-by-raster basis.

After the electrostatic latent image has been recorded on photoconductive surface 12, belt 10 advances the latent image to a development station C, where toner, in the form of liquid or dry particles, is electrostatically attracted to the latent image using commonly known techniques. Development station C contains the space optimizing toner cartridge described in detail below. Preferably, at development station C, a magnetic brush development system, indicated by reference numeral 38, advances developer material into contact with the latent image. Magnetic brush development system 38 includes two magnetic brush developer rollers 40 and 42. Rollers 40 and 42 advance developer material into contact with the latent image. These developer rollers form a brush of carrier granules and toner particles extending outwardly therefrom. The latent image attracts toner particles from the carrier granules forming a toner powder image thereon. As successive electrostatic latent images are developed, toner particles are depleted from the developer material. The toner particle dispenser, indicated generally by the reference numeral 80, dispenses toner particles into developer housing 46 of developer unit 38.

With continued reference to FIG. 9, after the electrostatic latent image is developed, the toner powder image present on belt 10 advances to transfer station D. A print sheet 102 is advanced to the transfer station, D, by a sheet feeding apparatus, 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image formed thereon contacts the advancing sheet at transfer station D. Transfer station D includes a corona generating device 58 which sprays ions onto the back side of sheet 102. This attracts the toner powder image from photoconductive surface 12 to sheet 102. After transfer, sheet 102 continues to move in the direction of arrow 60 onto a conveyor (not shown) which advances sheet 102 to fusing station E.

The fusing station, E, includes a fuser assembly, indicated generally by the reference numeral 62, which permanently affixes the transferred powder image to sheet 102. Fuser assembly 60 includes a heated fuser roller 64 and a back-up roller 66. Sheet 102 passes between fuser roller 64 and back-up roller 66 with the toner powder image contacting fuser roller 64. In this manner, the toner powder image is permanently affixed to sheet 102. After fusing, sheet 102 advances through chute 68 again through the decurler assembly 150 of the present invention to catch tray 72 for subsequent removal from the printing machine by the operator.

After the print sheet is separated from photoconductive surface 12 of belt 10, the residual toner/developer and paper fiber particles adhering to photoconductive surface 12 are removed therefrom at cleaning station F. Cleaning station F includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 1:
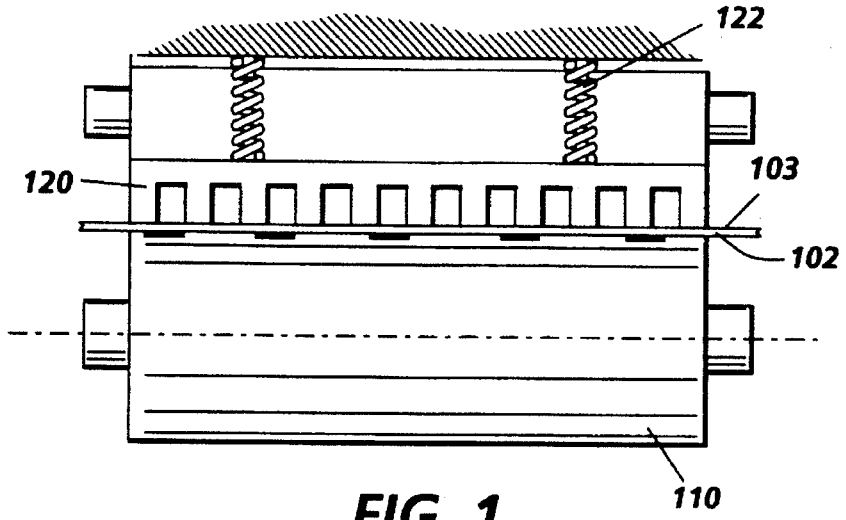
FIG. 1 is an elevational view of a first embodiment of the localized identation decurler herein using a ribbed skid plate.
Figure 2:
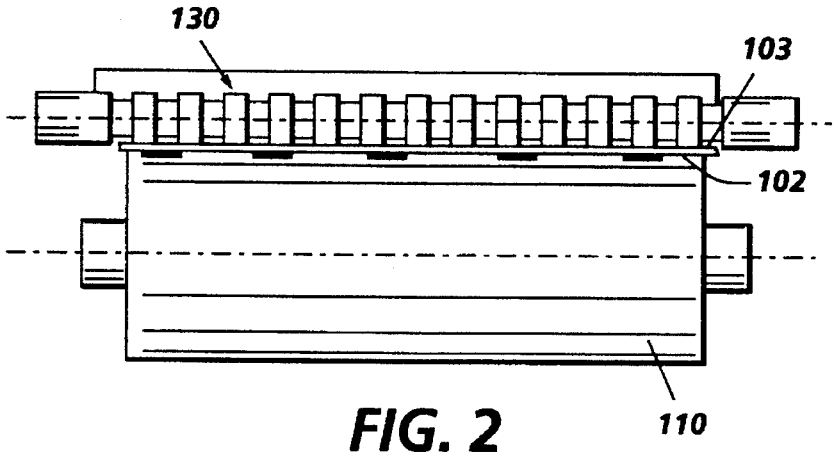
FIG. 2 is an elevational view of a second embodiment of the localized identation decurler herein utilizing a ribbed roll.
Figure 3:
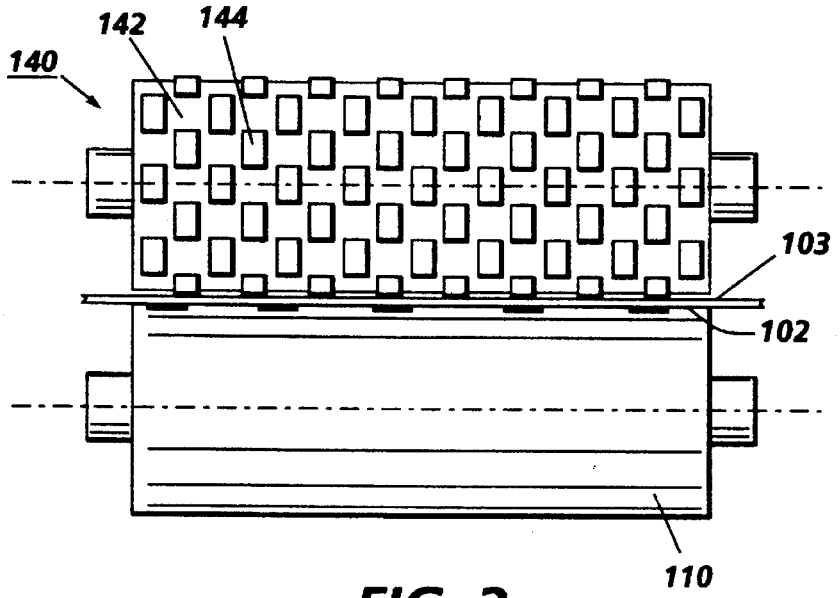
FIG. 3 is an elevational view of a third embodiment of the localized identation decurler herein utilizing a studded roll.

Turning now to FIGS. 1, 2, and 3, there are shown three embodiments for producing small localized indentation on the non-image side of the sheet for reducing process and cross-curls. Indenting the paper fibers in small segments is more effective than conventional methods of feeding paper uniformly through a bending radius. Indentations create higher localized stresses beyond the yield stress of an individual fiber to cause permanent deformations to correct local curls. In each embodiment illustrated, the indentations are against a smooth elastomer surfaced roll 110 which does not corrugate the paper.

FIG. 1 illustrates a mechanism in which a fused copy sheet 102 is driven through a mechanism in which a ribbed surface 120 is applied against the non-image side 103 of the sheet 102. The ribbed surface 120 is biased against the sheet 102 by springs 122 or other biasing mechanism and held stationary. As discussed above, the drive roll 110 is an elastomer surfaced roll which drives the sheet 102 through the nip formed by the roll 110 and the ribbed surface 120. The ribbed surface contacts the non-imaged side of the sheet and cause bending of local areas in the cross direction thereby reducing cross curl.

FIG. 2 illustrates a ribbed roll 130 clamped against an elastomer drive roll 110. Preferably, the ribbed roll 130 is made of a material such as stainless steel which has a low coefficient of friction. As the sheet 102 is driven through the nip between the ribbed roll 130 and the drive roll 110, the lower interface friction between the paper 102 and the stainless steel ribbed roll 130 will cause the ribbed roll 130 to rotate slower than the high friction drive roll 110. As above the ribbed portion of the roll reduces cross curl in the sheet.

FIG. 3 illustrates an indenting roll 140 having a matrix of raised studs 144 on the roll surface 142. The alternately distributed studs 144 are for overstressing the fibers coming in contact in either the parallel or perpendicular directions to the sheet travel.

As the requisite indenting force to reduce the cross curl depends on various factors such as paper basis weight, toner layer thickness, and area coverage, a variable control mechanism can be built into the device for self-adjusting the indenting force according to various inputs which detect the aforesaid variables. Additionally, the hardware may be designed and controlled so that no indenting force is applied or that the indenting decurler is bypassed in the case of duplex copies or heavy weight papers.

Image information from the ESS 29, basis weight information from the basis weight detector 57, and moisture content information from humidity sensor 67 are some of the variables which can be utilized to control the decurler 150. The basis weight detector 57 can be of the type described in U.S. Pat. No. 5,138,178 which utilizes an infrared emitter and a phototransistor receptor to determine the weight of the sheet based on the voltage output variance of the phototransistor as the sheet passes between the emitter and receptor, the relevant portions thereof being hereby incorporated into this application. The humidity sensor 67 can be of the type utilized in the Xerox 5775 digital color copier.

In a light lens type copying machine which does not utilize an IPS, a densitometer or other sensor or array thereof can be utilized to determine image density on a sheet and emit a signal to the controller. Since the image has been developed, the patterns thereof are optically readable by illuminating them with a light emitter and sensing the patterns of reflected light. The sensor then emits a signal indicative of the density of the illuminated pattern. One such example of a densitometer is described in U.S. Pat. No. 5,053,822, the relevant portions thereof being hereby incorporated into this application.

Figure 4:
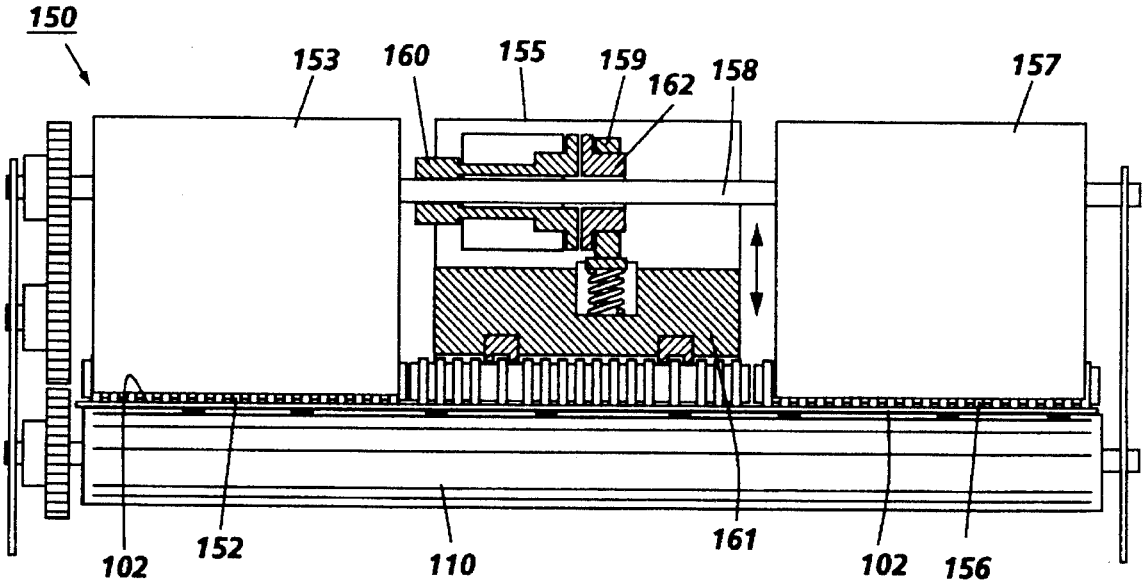
FIG. 4 is an elevational view of a cam actuated segmented localized indentation decurler of the invention herein.
Figure 5:
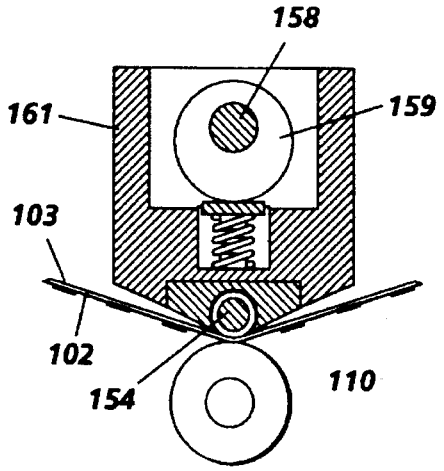
FIG. 5 is an end view of the FIG. 4 decurler.

Turning next to FIGS. 4 through 7, there is illustrated a segmented indenting type decurling device in which the indenting force may be varied across the width of a sheet in a direction transverse to the process direction. Turning first to FIGS. 4 and 5 there is illustrated a three segment ribbed indenting decurling roll assembly 150. Each segment 152, 154, 156 of the ribbed decurling roll is coupled to a clutch 160 operated actuator 153, 155, 157 which determines the degree of indenting force applied by the roll to the sheet. Again, a common elastomeric drive roll 110 is utilized to drive a sheet 102 through the nip between the drive roll 110 and the segmented indenting decurling rolls 152, 154, 156. To apply bending to local areas, a number of segmented shafts 152, 154, 156 can be used with each shaft being loaded by a cam 159 and controlled independently as shown in FIG. 4. For illustrative purposes only the center segment will be discussed herein but all three segments function in the same manner. A magnetic clutch, 160, is utilized to apply the normal force to the actuator 161 so that the segmented roll portion 154 is forced against the elastomer drive roll 110. A common actuator shaft 158 and a magnetic clutch 160 can be utilized to actuate the cam 159. The cam 159 is attached to the armature 162 of a clutch and the cam 159 will then rotate when the clutch 160 is energized. In operation, each magnetic clutch 160 receives a command from the controller 29 on the timing and duration of the on-off positioning of its cam 159 to load the indenting shaft 154. The controller 29 gets inputs from various system sensors and system software on the image distributions on the sheet in the three zones corresponding to the paths of the three segmented indenting shafts 152, 154 and 156. Based on local image area coverages and a threshhold value for applying the indenting load, the control software determines the on-off timing pattern of each indenting shaft; on for highly imaged areas, and off for areas having low area coverage. An advantage of the indentation method is the small penetration required for forming an effecting bending nip on the elastomer layered drive roll. With such a small level of penetration, a variance between zero (no decurling action) and the maximum along the axial direction of the shaft will not cause paper damage or other paper handling problems.

Figure 6:
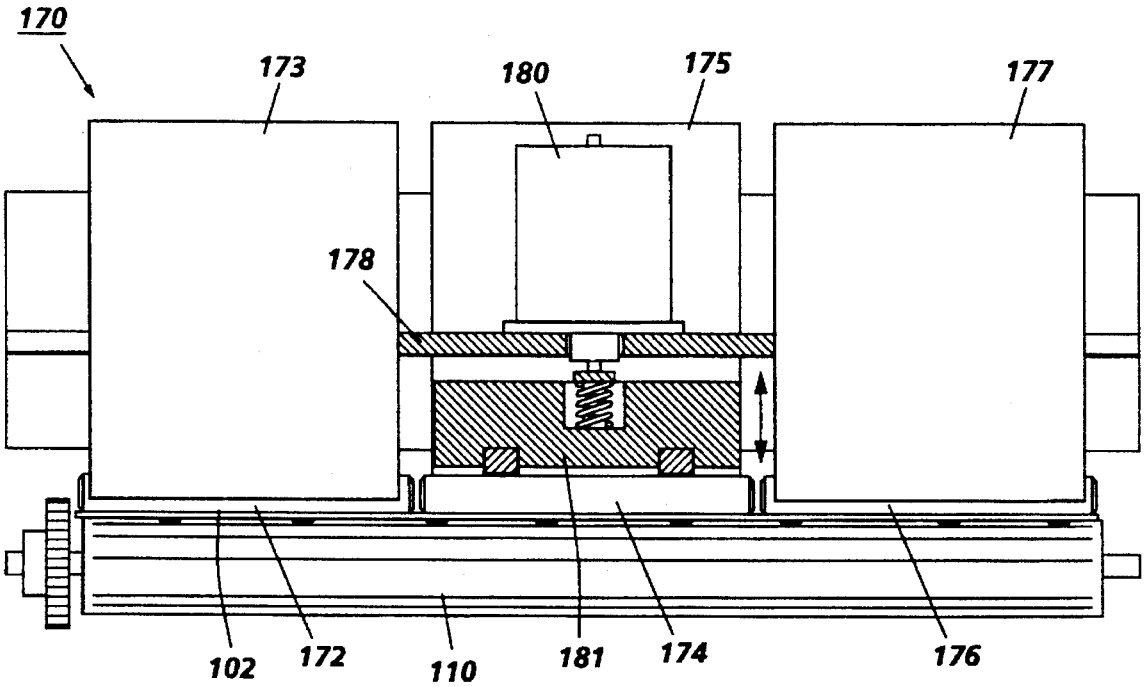
FIG. 6 is an elevational view of a solenoid actuated segmented localized decurler of the invention herein.
Figure 7:
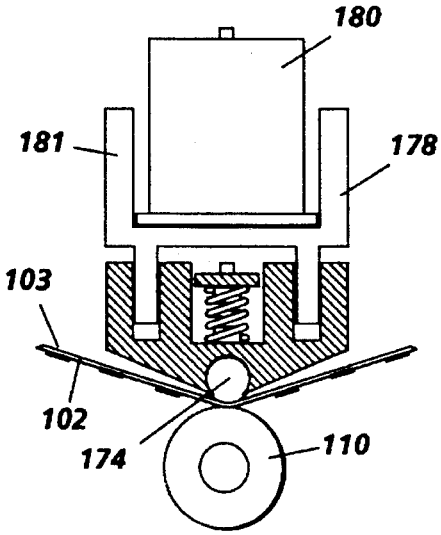
FIG. 7 is an end view of the FIG. 6 decurler.

An alternative mechanism, for independently loading the segmented shafts is shown in FIGS. 6 and 7. Linear solenoid actuator assemblies 173, 175, 177 are used for applying loads independently on the segmented smooth shafts 172, 174, 176. Each assembly includes a solenoid 180 mounted on a common base plate 178. The solenoid 180 causes actuator 181 to apply a load to the segmented shaft portion 174. This system has the advantage of not connecting to the drive system for the loading of the segments, therefore providing some improvement in the reliability of the overall system operation.

The segmented decurlers described above provide the ability to tailer the decurling forces to selectively decurl each sheet. This provides an advantage in that the amount of force can be varied not only in the process direction by timing the duration of the application of force but also in the transverse process direction due to the segmenting of the decurling device. This localized decurling ability is described in examples below.

Figure 8A:
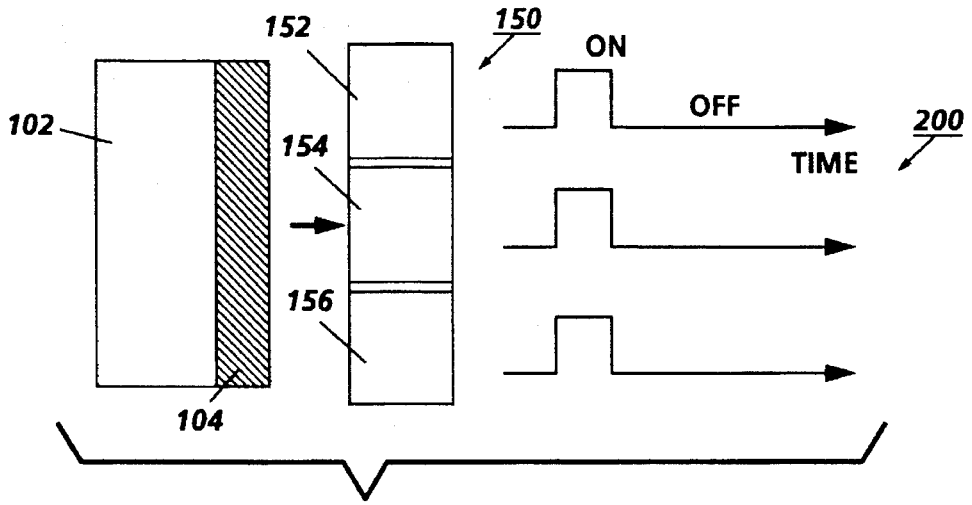
FIGS. 8A, 8B and 8C are graphical illustrations of the operation of the FIG. 4 decurler for three different image patterns.
Figure 8B:
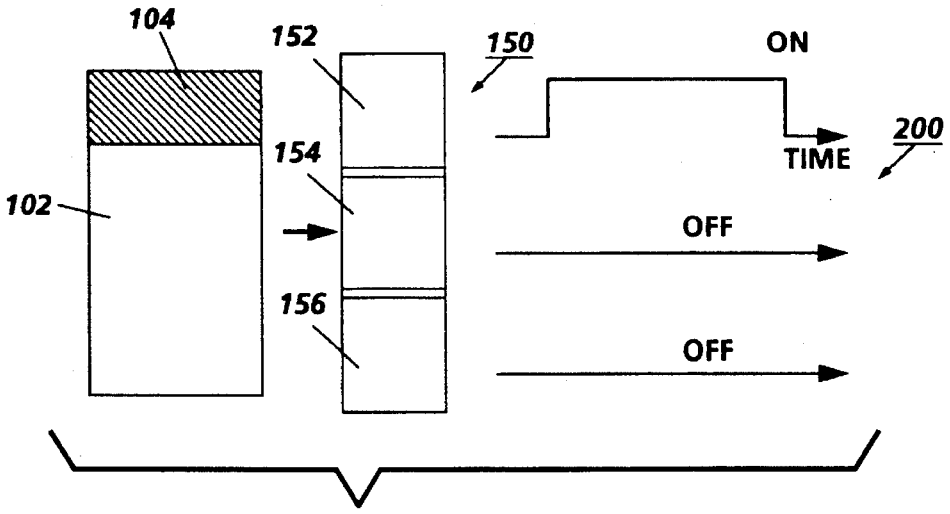
Figure 8C:
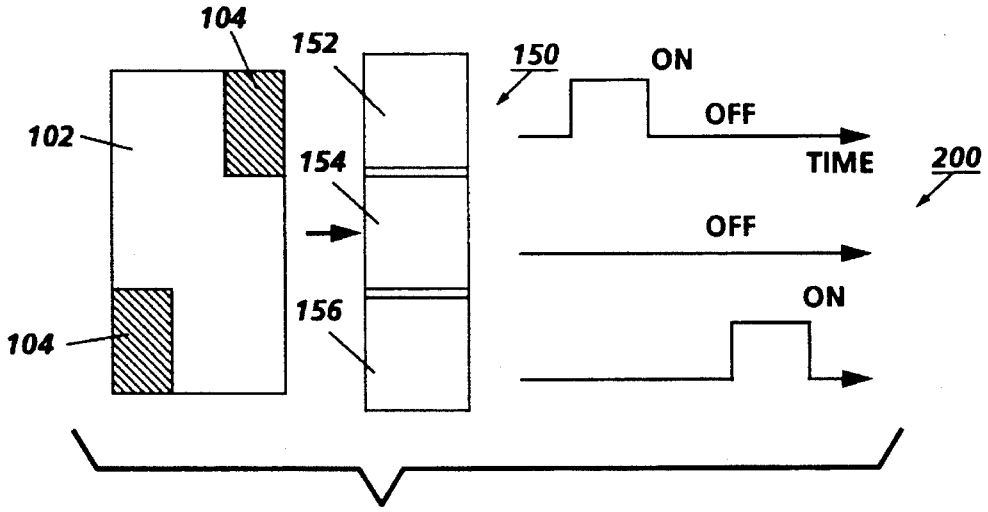

Turning next to FIGS. 8A, 8B and 8C, there are shown three examples of the decurler function for various copy sheet image configurations. As shown in FIG. 8A in which the full width shaded area strip 104 on the sheet 102 represents the image area as illustrated, all three decurler units 152, 154, 156 will be on for a short period of duration and then off. Each of the on-off periods are represented by the graphical representation 200. Turning next to FIG. 8B, again the imaged area is represented by the shaded full length strip 104 on the sheet 102. For this example, decurler 152 will be on for a longer duration while decurler segments 154 and 156 will be off for the entire passage of the sheet 102. Lastly, turning to FIG. 8C, again where the shaded diagonal corner portions 104 represent the imaged areas on the sheet 102, the decurler segment 152 will be initially on and then off for a certain time period, decurler segment 154 will be off for the entire time period and decurler segment 156 will be initially off and then on for a time period to effect the decurling of the sheet 102.

Obviously, for various other image configurations, many different combinations of decurler segments on-off are possible. Additionally, for more sophisticated software control, segmented shafts may have several indentation levels that can react to the input of toner layer thicknesses or color modes.

In recapitulation, there is provided an apparatus for adaptive localized sheet decurling in an electrophotographic printing machine. A segmented decurling device forms a drive nip with an elastically deformable surfaced roll. A plurality of sensors are provided to determine the basis weight of the copy sheet, the density of the image being transferred to the copy sheet and fused thereon, the relative humidity of the machine environment, the process speed of the print engine,and any other relevant parameters. Signals indicative of these parameters are generated and sent to the machine controller which processes these signals to determine the proper decurler segment settings based upon the degree of curl expected in a sheet. Based on the degree of of curl expected for each sheet section corresponding to a decurler segment, the decurler segment is actuated to a setting to provide the proper amount of mechanical decurling force. Each decurling segment is activated only for the duration deemed necessary to decurl the imaged sheet portion corresponding thereto.

It is, therefore, apparent that there has been provided in accordance with the present invention, an adaptive localized selective indentation decurler that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A printing machine in which an image is fixed to a sheet, wherein the improvement comprises:

a drive member having an elastically deformable surface; and a decurling member adjacent said drive member to form a nip therebetween, said decurling member including a plurality of protrusions extending outwardly from a portion of a surface in the nip to cause localized deformation of the sheet in a direction transverse to a direction of sheet travel passing through the nip.

2. A printing machine according to claim 1, further comprising a biasing member to urge said decurling member into engagement with said drive member.

3. A printing machine according to claim 1, further comprising:

means for determining at least one of a plurality of parameters of the sheet and generating a signal indicative thereof:

an adjustable biasing member urging said decurling member into engagement with said drive member; and a controller, responsive to the signal from said determining means, for adjusting said biasing member.

4. A printing machine according to claim 1, wherein said decurling member comprises a plurality of sections extending in a direction substantially transverse to a direction of sheet travel through the nip, each of said sections being actuable on a different portion of the sheet transverse to the direction of sheet travel.

5. A printing machine according to claim 4, further comprising:

means for determining at least one of a plurality of parameters of the sheet and generating a signal indicative thereof;

an adjustable biasing member urging each one of said plurality of sections into engagement with said drive member; and a controller, responsive to the signal from said determining means, for adjusting each of said biasing member segments independently of one another.

6. A printing machine according to claim 1, wherein said decurling member comprises a ribbed generally planar member mounted in contact with said drive member.

7. A printing machine according to claim 1, wherein said decurling member comprises a ribbed roll in frictional contact with said drive member, said ribbed roll having a low coefficient of friction relative to said drive member.

8. A printing machine according to claim 1, wherein said drive member comprises a drive roll.

9. A printing machine in which an image is fixed to a sheet, wherein the improvement comprises:

a drive member having an elastically deformable surface; and a plurality of decurling sections adjacent said member to form a nip therebetween, said plurality of sections extending in a direction substantially transverse to a direction of sheet travel through the nip.

10. A printing machine according to claim 9, further comprising:

means for determining at least one of a plurality of parameters of the sheet and generating a signal indicative thereof;

an adjustable biasing member urging each one of said plurality of sections into engagement with said drive member; and a controller, responsive to the signal from said determining means, for adjusting each of said biasing member segments independently of one another.

11. A method for predicting the amount of curl in a sheet and applying a variable localized decurling force, comprising the steps of:

determining at least one of a plurality of parameters effecting decurling a sheet and generating a parameter signal indicative thereof; and adjusting, in response to the parameter signal, the decurling force being applied to specific portions of the sheet, in both a process and cross process direction, by a sheet decurler.

12. A apparatus for decurling a sheet, comprising:

a drive member having an elastically deformable surface; and a decurling member adjacent said member to form a nip therebetween, said decurling member including a plurality of protrusions extending outwardly from a portion of a surface in the nip to cause localized deformation of the sheet passing through the nip.

13. An apparatus according to claim 12, further comprising a biasing member to urge said decurling member into engagement with said drive member.

14. An apparatus according to claim 12, further comprising:

means for determining at least one of a plurality of parameters of the sheet and generating a signal indicative thereof;

an adjustable biasing member urging said decurling member into engagement with said drive member; and a controller, responsive to the signal from said determining means, for adjusting said biasing member.

15. An apparatus according to claim 12, wherein said decurling member comprises a plurality of sections in extending a direction substantially transverse to a direction of sheet travel through the nip.

16. An apparatus according to claim 15, further comprising:

means for determining at least one of a plurality of parameters of the sheet and generating a signal indicative thereof;

an adjustable biasing member urging each one of said plurality of sections into engagement with said drive member; and a controller, responsive to the signal from said determining means, for adjusting each of said biasing member segments independently of one another.

17. An apparatus according to claim 12, wherein said decurling member comprises a ribbed generally planar member mounted in contact with said drive member.

18. An apparatus printing machine according to claim 12, wherein said decurling member comprises a ribbed roll in frictional contact with said drive member, said ribbed roll having a low coefficient of friction relative to said drive member.

19. An apparatus according to claim 12, wherein said drive member comprises a drive roll.

20. An apparatus according to claim 12, wherein said decurling member comprises a roll having a pattern of alternating protrusions, said roll being in frictional contact with said drive member.

* * * * *